US010235951B2

(12) United States Patent
Maruyama et al.

(10) Patent No.: US 10,235,951 B2
(45) Date of Patent: Mar. 19, 2019

(54) LIQUID CRYSTAL DISPLAY DEVICE

(71) Applicant: Panasonic Liquid Crystal Display Co., Ltd., Hyogo (JP)

(72) Inventors: Junichi Maruyama, Hyogo (JP); Takashi Nakai, Hyogo (JP); Ryutaro Oke, Hyogo (JP)

(73) Assignee: PANASONIC LIQUID CRYSTAL DISPLAY CO., LTD., Kyogo (JP)

( * ) Notice: Subject to any disclaimer, the term of this patent is extended or adjusted under 35 U.S.C. 154(b) by 99 days.

(21) Appl. No.: 15/475,177

(22) Filed: Mar. 31, 2017

(65) Prior Publication Data

US 2018/0286330 A1 Oct. 4, 2018

(51) Int. Cl.
*G09G 3/36* (2006.01)

(52) U.S. Cl.
CPC ..... *G09G 3/3614* (2013.01); *G09G 3/3607* (2013.01); *G09G 3/3688* (2013.01); *G09G 2310/027* (2013.01); *G09G 2310/0289* (2013.01)

(58) Field of Classification Search
CPC .. G09G 3/3614; G09G 3/3607; G09G 3/3688; G09G 2310/0289; G09G 2310/027
See application file for complete search history.

(56) References Cited

U.S. PATENT DOCUMENTS

| | | | | |
|---|---|---|---|---|
| 7,800,637 | B2 * | 9/2010 | Huang | G09G 3/2011 345/690 |
| 2007/0103420 | A1 * | 5/2007 | Chao | G09G 3/3611 345/98 |
| 2009/0102766 | A1 | 4/2009 | Oke et al. | |
| 2011/0234569 | A1 | 9/2011 | Ooishi et al. | |
| 2012/0229524 | A1 | 9/2012 | Toshima et al. | |
| 2012/0268504 | A1 * | 10/2012 | Irie | G09G 3/3614 345/690 |
| 2014/0362070 | A1 | 12/2014 | Ooishi et al. | |
| 2016/0125820 | A1 * | 5/2016 | Ito | G09G 3/3685 345/691 |
| 2016/0140927 | A1 * | 5/2016 | Maruyama | G09G 3/2007 345/89 |

* cited by examiner

*Primary Examiner* — Rodney Amadiz
(74) *Attorney, Agent, or Firm* — HEA Law PLLC

(57) ABSTRACT

A liquid crystal display (LCD) device and a method for driving LCD. Such a device may have a plurality of LCD pixels in a matrix, a driver that inputs a drive signal to each pixel selectively and a controller that controls a level and a polarity of the drive signal, and a memory storing corrected charge voltage values. Each pixel is provided with the drive signal based on the corrected charge voltage values for the corresponding pixel during the entirety of a horizontal period, and the corrected charge voltage value has a predetermined value corresponding to a charge for an intended gray scale level of the pixel at the end of the horizontal period without an over shooting of the driving voltage. When the target gray scale of the pixels is at the brightest level, a predetermined negative corrected charge is applied to the pixel to avoid an after image.

12 Claims, 11 Drawing Sheets

| Positive | | Target Gray Scale | | | | | |
|---|---|---|---|---|---|---|---|
| | | 0 | 128 | 256 | 512 | 768 | 1023 |
| Start Gray Scale | 0 | 0 | 6 | 20 | 38 | 45 | 0 |
| | 128 | 0 | 0 | 6 | 17 | 24 | 0 |
| | 256 | 0 | -1 | 0 | 9 | 17 | 0 |
| | 512 | 0 | -4 | -4 | 0 | 11 | 0 |
| | 768 | 0 | -7 | -11 | -7 | 0 | 0 |
| | 1023 | 0 | -18 | -32 | -34 | -15 | 0 |

| Negative | | Target Gray Scale | | | | | |
|---|---|---|---|---|---|---|---|
| | | 0 | 128 | 256 | 512 | 768 | 1023 |
| Start Gray Scale | 0 | 0 | 6 | 20 | 38 | 45 | -10 |
| | 128 | 0 | 0 | 6 | 17 | 24 | -8 |
| | 256 | 0 | -1 | 0 | 9 | 17 | -4 |
| | 512 | 0 | -4 | -4 | 0 | 11 | 0 |
| | 768 | 0 | -7 | -11 | -7 | 0 | 0 |
| | 1023 | 0 | -18 | -32 | -34 | -15 | 0 |

705

Fig. 7C

| Positive | | Target Gray Scale (Unit voltage) | | | | | |
|---|---|---|---|---|---|---|---|
| | | 0 | 128 | 256 | 512 | 768 | 1023 |
| Start Gray Scale | 0 | 0 | 0.032 | 0.060 | 0.094 | 0.182 | 0 |
| | 128 | 0 | 0 | 0.018 | 0.042 | 0.094 | 0 |
| | 256 | 0 | -0.007 | 0 | 0.022 | 0.066 | 0 |
| | 512 | 0 | -0.027 | -0.013 | 0 | 0.042 | 0 |
| | 768 | 0 | -0.048 | -0.036 | -0.017 | 0 | 0 |
| | 1023 | 0 | -0.128 | -0.106 | -0.080 | -0.042 | 0 |

| Negative | | Target Gray Scale | | | | | |
|---|---|---|---|---|---|---|---|
| | | 0 | 128 | 256 | 512 | 768 | 1023 |
| Start Gray Scale | 0 | 0 | -0.034 | -0.048 | -0.093 | -0.166 | 0.250 |
| | 128 | 0 | 0 | -0.015 | -0.041 | -0.086 | 0.204 |
| | 256 | 0 | 0.007 | 0 | -0.022 | -0.060 | 0.106 |
| | 512 | 0 | 0.027 | 0.014 | 0 | -0.039 | 0 |
| | 768 | 0 | 0.048 | 0.039 | 0.021 | 0 | 0 |
| | 1023 | 0 | 0.128 | 0.114 | 0.102 | 0.050 | 0 |

705

Fig. 7D

LIQUID CRYSTAL DISPLAY DEVICE

BACKGROUND

A liquid crystal display (LCD) modulates light flow by rotating the alignment of liquid crystal molecules to control the amount of light which enters a polarizing filter film with a vertical (or horizontal) axis and passes through another polarizing filter film with a horizontal (or vertical) axis. The liquid crystal molecules are aligned between the two polarizing filter films and the axis of the filters may be perpendicular or parallel from each other. Here, the rotation of the liquid crystal molecules is modulated by the electrical setting because each liquid crystal molecule is aligned along with an electric field which can be made by the electrical setting for an individual pixel. Various kinds of the electrical settings have been developed, but generally, the rotation angle and speed are decided by the voltage level of the electric field. Thus, the voltage decides the gray scale level of each LCD pixel.

Generally, the voltage for the gray scale level is called a driving or data driving voltage. FIG. 1 shows the relationship between the driving voltage and the gray scale level. As shown in FIG. 1, the driving voltage may have either positive or negative polarity to display a same gray scale because the liquid crystal may rotate to either direction with the same manner of the light control. Usually, the voltage which is higher than the common voltage ($V_0$) becomes a voltage of positive polarity, and a voltage which is lower than $V_0$ becomes a voltage of negative polarity.

One of the key issues with LCDs is that the rotation speed of liquid crystal molecules is relatively slow, below the image refresh rate (frame rate). For example, in the case of Amorphous Silicon (a-Si) TFT-LCD, the mobility of a-Si is approximately 0.3-0.5 (cm/Vs), which is not sufficient when a scene is changing fast or there is a fast moving objects on the scene (the scene is blurred or the object can be disappeared from the scene). Usually, each LCD pixel is modeled as a capacitor where the full rotation time of liquid crystal molecules is considered as a full charging time of the capacitor model. Thus, the above issue is generally known as a "short charge time" or "short response time" of a pixel. Also, sometimes, the voltage which is charged in the capacitor model is called as a potential.

Various solutions have been developed to solve the short charge time problem. One of the solutions is compensating the charge time of the pixel by overdriving the pixel with initial high pre-charge voltage. Here, the initial high voltage should be higher than the real data voltage of the target gray scale level. After the initial high pre-charge voltage, the voltage should be modulated as the gray scale of the pixel approaches the target level. The initial high voltage enables the rotation of liquid crystals to be faster, and then the voltage should be eased off as it reaches the target gray scale level.

FIG. 2 shows a comparison of the cases where there is a short charged pixel without the initial high pre-charge voltage and a fully charged pixel with the initial high pre-charge voltage. The left case of FIG. 2 shows that the pixel is not charged enough to display the target gray scale level due to the limited horizontal period (1H: one horizontal period) and the characters are blurred on the screen. On the other hand, the one on the right shows that the pixel is charged enough to display the target scale level within the same horizontal period (1H) and the characters on the screen are sharper than the left one through applying the initial high pre-charge voltage.

However, this conventional initial high pre-charge voltage has some disadvantages. First, the conventional initial high pre-charge voltage requires relatively high voltage. Further, in the conventional initial high pre-charge voltage, too much high voltage may cause the pixel to display a wrong target gray scale level and the voltage needs to be reduced before this happens. Also, a data driver with double speed is required because the horizontal period (1H) should be divided into a pre-charge period and a real data period for a pixel.

Also, as shown in FIG. 3, when one color image which is an intermediate gray scale level is displayed after both white and black (maximum and minimum gray scale levels) are displayed at the same frame during some period, an "after image" occurs on a boundary between the white and black images. The detail explanation why the after image occurs is to be discussed below.

Therefore, exemplary objects of the present disclosure involve solving the above problems by compensating the pixel charge time with half driving speed of the conventional driving method without the initial high charging voltage. Also, an additional object of the present disclosure is to solve the after image problem.

SUMMARY

According to at least one exemplary embodiment, a liquid crystal display (LCD) device and a method for driving an LCD may be shown described. Such a device and method may enable each LCD pixel to be selectively and concurrently charged up to an intended gray scale level at the end of horizontal period without initial high pre-charging voltage. Also, the device and method may enable each LCD pixel to avoid side effects, such as an after image.

Such a LCD device may include a plurality of LCD pixels in a matrix; a driver that inputs a drive signal to each LCD pixel of the plurality of LCD pixels; a controller that controls a level and a polarity of the drive signal; and a memory storing a plurality of corrected charge voltage values. Further, each LCD pixel in the plurality of LCD pixels is provided with the drive signal based on the corrected charge voltage values for the corresponding LCD pixel during the entirety of a horizontal period, and wherein the corrected charge voltage value has a predetermined value corresponding to a charge for an intended gray scale level of the LCD pixel at the end of the horizontal period. Also, in the display device, the corrected charge voltage value has the predetermined value that of the LCD pixel to be charged up to the intended gray scale level at the end of the horizontal period without an over shooting of the drive signal. Further, in the display device, the driver inputs the drive signal to each LCD pixel in the plurality of LCD pixels selectively. Additionally, in the display device, an absolute value of the corrected charge voltage value is less for a predetermined gray scale level when the polarity of the drive signal is a negative than the absolute value of the corrected charge when the polarity of the drive signal is a positive for the predetermined gray scale level.

In another exemplary embodiment, the memory may further include a plurality of look up tables having positive corrected charge voltage values and negative corrected charge voltage values of the corrected charge voltage values based on a polarity of a driving voltage, a pixel location, and a temperature of the display, wherein the controller controls the level of the drive signal depending on an absolute value of the corrected charge voltage values.

Also, the memory may further include at least one of a positive and negative lookup table pair having a plurality of positive and negative corrected charge voltage values, a plurality of starting gray scale levels from a minimum level to a maximum level, and a plurality of target gray scale levels from a minimum level to a maximum level. In this exemplary embodiment, the starting gray scale level is a gray scale level of the LCD pixel on a previous horizontal period and the target gray scale is a gray scale level of the LCD pixel on a current horizontal period, the controller controls the driver to input a corrected charge voltage value as the drive signal to the LCD pixel through use of the positive lookup table when the polarity of the driving signal has a positive charge and the negative lookup table when the polarity of the driving signal has a negative charge, at least one of the positive and negative corrected charge voltage values in the lookup table are determined by each starting gray scale level and each target gray scale level, and, when the target gray scale level of the negative lookup table is at the brightest level, the corrected charge voltage value is a predetermined negative corrected charge voltage value that is sufficient to avoid an after image.

In still another exemplary embodiment, when a target gray scale of a first pixel and a second pixel is at the brightest level, the controller may control the driver to input a first corrected charge voltage as the drive signal to the first pixel and to input a second corrected charge voltage as the drive signal to the second pixel, wherein the polarity of the drive signal is a positive for the first pixel and the polarity of the drive signal is a negative for the second pixel, and wherein the first pixel displays a predetermined luminescence with the first corrected charge voltage and the second pixel displays the predetermined luminescence with the second corrected charge voltage.

In another exemplary embodiment, a method for driving LCD may be described. Such a method may include storing a plurality of corrected charge voltage values for pixels in a memory; determining a pixel location; determining the corrected charge voltage value for the pixel from the memory; and applying one of a positive or a negative corrected charge voltage to the pixel during a horizontal period based on the pixel location and the corrected charge voltage value. In the method the plurality of corrected charge voltage values can include a plurality of positive corrected charge voltage values and a plurality of negative corrected charge voltage values, and the negative corrected charge voltage value and the positive corrected charge voltage value each have a predetermined value of the pixel to be charged up to an intended gray scale level at the end of the horizontal period, the negative corrected charge voltage value has an absolute value less than or equal to the positive corrected charge voltage value for a same gray scale level, and, when applying one of the positive or the negative corrected charge voltage, the pixel is charged during the entirety of the horizontal period without an over shooting of the positive or the negative corrected charge voltage, wherein the starting gray scale level is a gray scale level of the LCD pixel on a previous horizontal period and the target gray scale is the gray scale level of the LCD pixel on a current horizontal period, wherein, when the target gray scale is at the brightest level, the corrected charge voltage value is a predetermined negative corrected charge voltage value that is sufficient to avoid an after image, and wherein a plurality of the pixel locations are determined concurrently and a plurality of the pre-charge values are determined concurrently, and a plurality of positive or negative pre-charge voltages are applied concurrently depending on an external image source.

Also, the method may further include checking whether a first pixel and a second pixel are to be charged to the brightest gray scale level; determining a first corrected charge voltage value for the first pixel and a second corrected charge voltage value for the second pixel; and applying a first corrected charge voltage to the first pixel according to the first corrected charge voltage value and a second corrected charge voltage to the second pixel according to the first second charge voltage value, wherein the polarity of the first corrected charge voltage is a positive and the polarity of the second corrected charge voltage is a negative, and wherein the first pixel displays a predetermined luminescence with the first corrected charge voltage and the second pixel displays the predetermined luminescence with the second corrected charge voltage.

BRIEF DESCRIPTION OF THE FIGURES

Advantages of embodiments of the present application will be apparent from the following detailed description of the exemplary embodiments thereof, which description should be considered in conjunction with the accompanying drawings in which like numerals indicate like elements, in which:

FIG. 7C provides exemplary look up tables showing the corrected charge voltage data as a gray scale value;

FIG. 7D provides exemplary look up tables showing the corrected charge voltage data as a voltage value;

DETAILED DESCRIPTION

Aspects of the invention are disclosed in the following description and related drawings directed to specific embodiments of the application. Alternate embodiments may be devised without departing from the spirit or the scope of the invention. Additionally, well-known elements of exemplary embodiments of the application will not be described in detail or will be omitted so as not to obscure the relevant details of the embodiments. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Further, many of the embodiments described herein are described in terms of sequences of actions to be performed by, for example, elements of a computing device. It should be recognized by those skilled in the art that the various sequences of actions described herein can be performed by specific circuits (e.g. application specific integrated circuits (ASICs)) and/or by program instructions executed by at least one processor. Additionally, the sequence of actions described herein can be embodied entirely within any form of computer-readable storage medium such that execution of the sequence of actions enables the at least one processor to perform the functionality described herein. Furthermore, the sequence of actions described herein can be embodied in a combination of hardware and software. Thus, the various aspects of the present application may be embodied in a number of different forms, all of which have been contemplated to be within the scope of the claimed subject matter. In addition, for each of the embodiments described herein, the corresponding form of any such embodiment may be described herein as, for example, "a computer configured to" perform the described action.

According to an exemplary embodiment, and referring to the Figures generally, a liquid crystal display (LCD) device and a method for driving an LCD may be provided. According to one exemplary embodiment, the device and the method may enable each display pixel to be selectively and concurrently charged up to an intended gray scale level at the end of horizontal period without initial high pre-charging voltage. Also, the device and the method may enable each display pixel to avoid side effects such as an after image. The device and the method may save the pixel charging time in half compared to the conventional initial high pre-charge voltage driving and may reduce the number of drivers in half.

Figure 4:
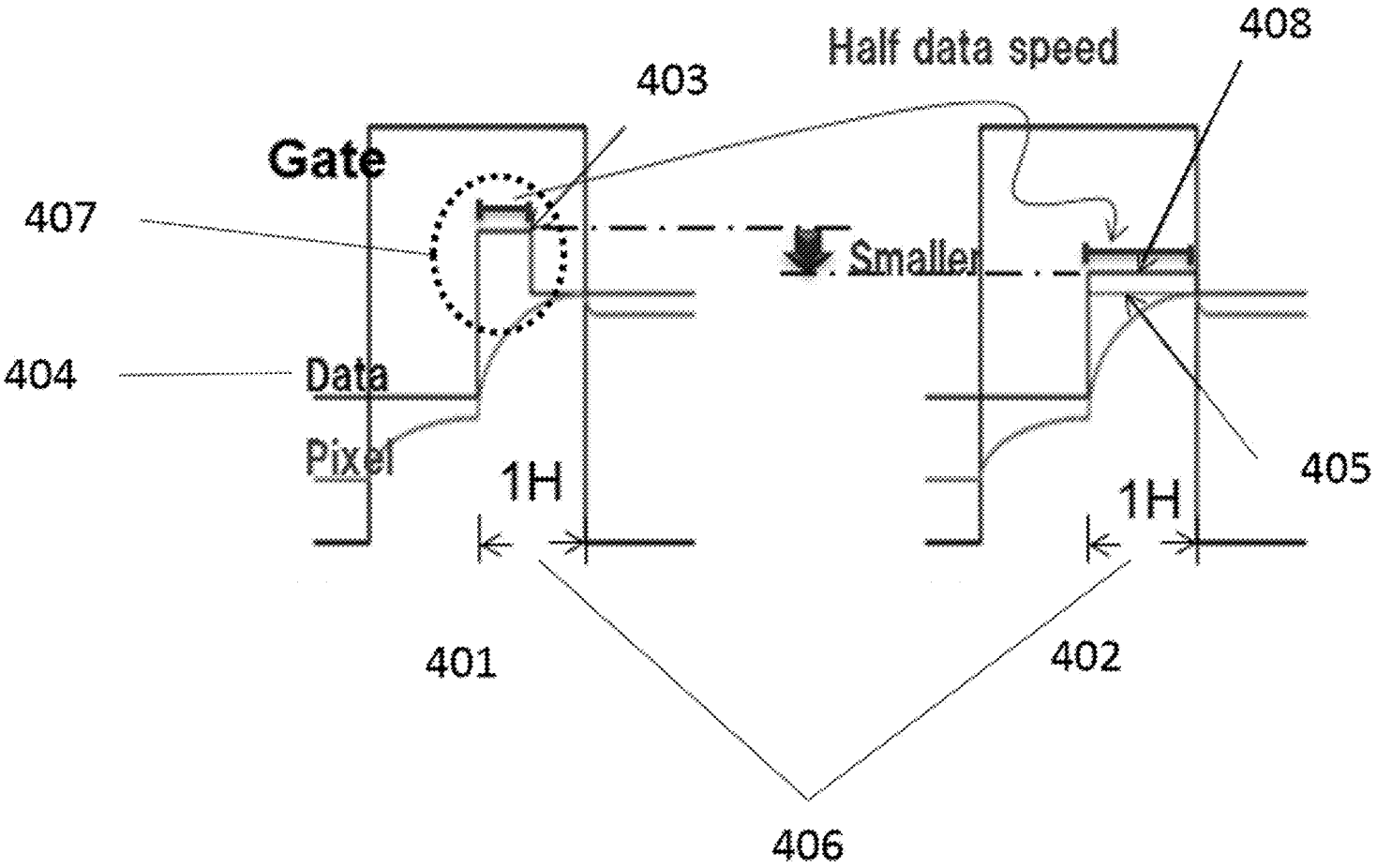
FIG. 4 shows schematic waveforms showing a comparison of the cases where: (1) the driving of a pixel with the conventional initial high pre-charge voltage; and (2) the driving of a pixel with the corrected charge voltage according to an exemplary embodiment.

Turning now to exemplary FIG. 4, FIG. 4 compares the cases of the driving pixel with the conventional initial high pre-charge voltage driving 401; and the driving pixel with the corrected charge voltage 402, according to an exemplary embodiment. As shown in FIG. 4, the corrected charge voltage driving 402 may reduce the actual complementary voltage by applying the corrected charge voltage 408 during the entirety of the horizontal period 406 (1H) without the initial high pre-charging voltage 403. Here, the initial high pre-charging voltage is also known as an over shooting of the voltage or an over-driving. The corrected charge voltage 408 is higher than the real data voltage for the target gray scale level 405, but lower than the initial high voltage 403 of the conventional driving method.

In an exemplary embodiment, the horizontal period is the period for the pixel to be charged. Referring to exemplary FIG. 8A, to help provide an understanding of the horizontal period and the pixel charging mechanism, generally, the LCD pixels may be arranged in matrix where the pixels may be connected via a data line 801 vertically and also connected via a gate line 802 horizontally. The pixels connected vertically by the data line 801 are charged in the order of the data line direction. Each pixel is charged during each corresponding horizontal period which is in sync with the gate on signal. The gate on signal is from a gate driver and each pixel is connected horizontally to the gate driver via the gate line 802.

Referring back to FIG. 4, a driver (the driver may be known as a data driver or a source driver which applies a writing voltage on the pixels for the image) inputs the corrected charge voltage 408 as a drive signal 404 via the data line to each pixel selectively and the drive signal 404 may be decided by corrected charge voltage value which stored in a memory. A controller may control the level and the polarity of the drive signal 404 based on the absolute value of the corrected charge voltage values in the memory. The driver inputs the drive signal 404 as the predetermined charge voltage value during the entirety of the horizontal period 406 without the over shooting 407. Here, the corrected charge voltage value in the memory may be predetermined to enable the LCD pixel to be charged up to a target gray scale level 405 (the intended gray scale level) at the end of the horizontal period 406. Because the horizontal period 406 does not need to be divided as a pre-charge period and a real data period, the required data speed could be doubled compared to the conventional initial pre-charge voltage driving.

Figure 5:
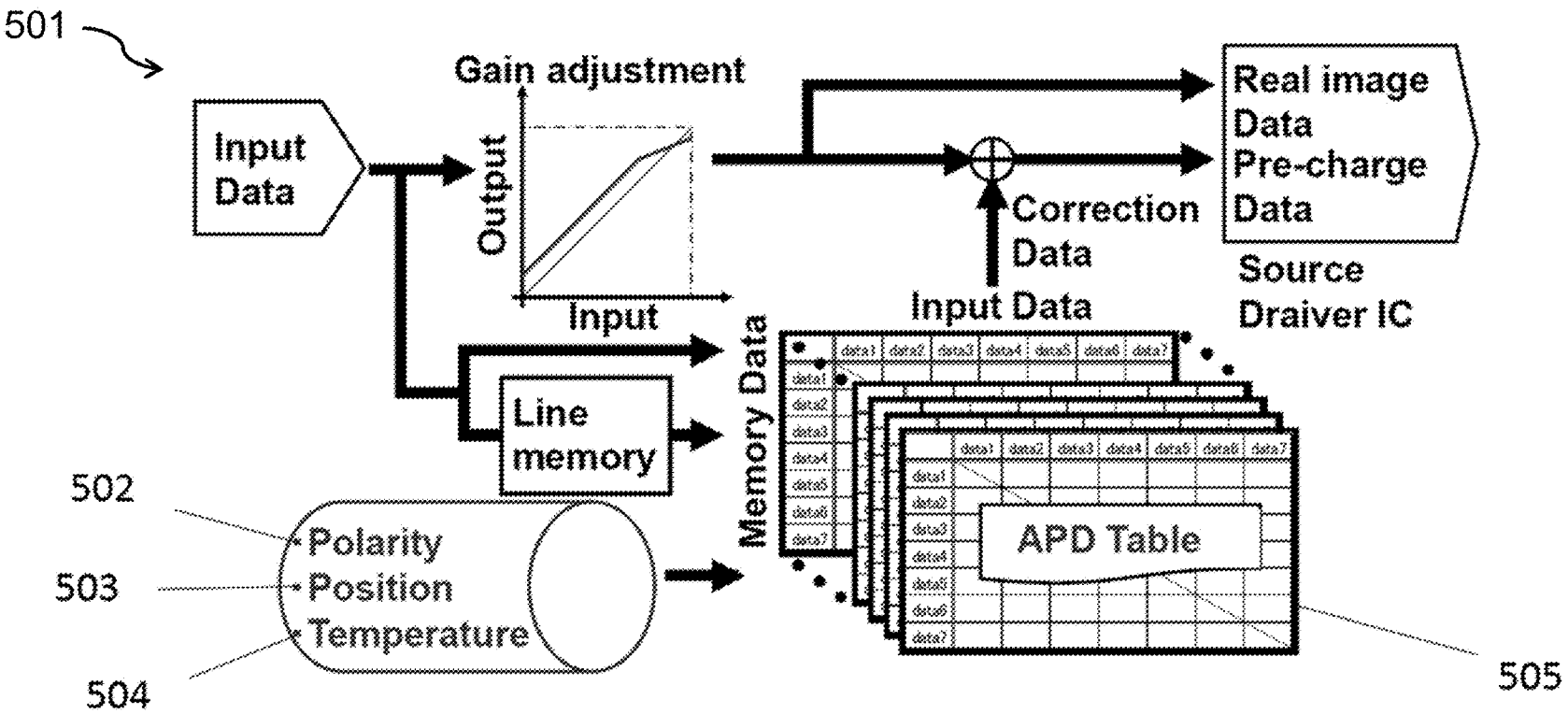
FIG. 5 is an exemplary block diagram showing an LCD driving system according to an exemplary embodiment.

Turning now to FIG. 5, FIG. 5 shows a LCD driving system 501 according to an exemplary embodiment. According to an exemplary embodiment, the driving signal value (corrected charge voltage value) is to be determined by considering the desired gray scale level (the target gray scale) as well as a polarity 502 of the driving signal voltage, each pixel location 503 and/or a temperature 504. For example, if the pixel location is physically close to the driver, an absolute value of corrected charge voltage value may be relatively small because the pixel can be charged up to the target gray scale with only small electrical loss. Also, if the temperature 504 is low, the absolute value of the corrected charge voltage value may be relatively high because the rotation speed of liquid crystal molecules are slow under the low temperature.

Also, in an exemplary embodiment, if the polarity 502 of the driving signal voltage is positive, the polarity of the corrected charge voltage value is positive, and if the voltage is negative, the corrected charge voltage value is negative. In another exemplary embodiment, the corrected charge voltage value may be expressed as the corrected charge voltage data which are actually gray scale level values. Then, the corrected charge voltage data is included in different kinds of look up tables depending on the voltages polarities.

In an exemplary embodiment, all data may be stored in the memory as a set of look up tables 505. As described above, the corrected charge voltage value may be stored as a positive value or a negative value depending the polarity 502 of the driving voltage. When the controller controls the drive signal considering the corrected charge voltage values of the memory, the controller may control the level of the drive signal depending on an absolute value of the corrected charge voltage value and may control the polarity 502 of the drive signal depending on the polarity of the corrected charge voltage value or the polarity of the corrected charge voltage data.

Figure 6:
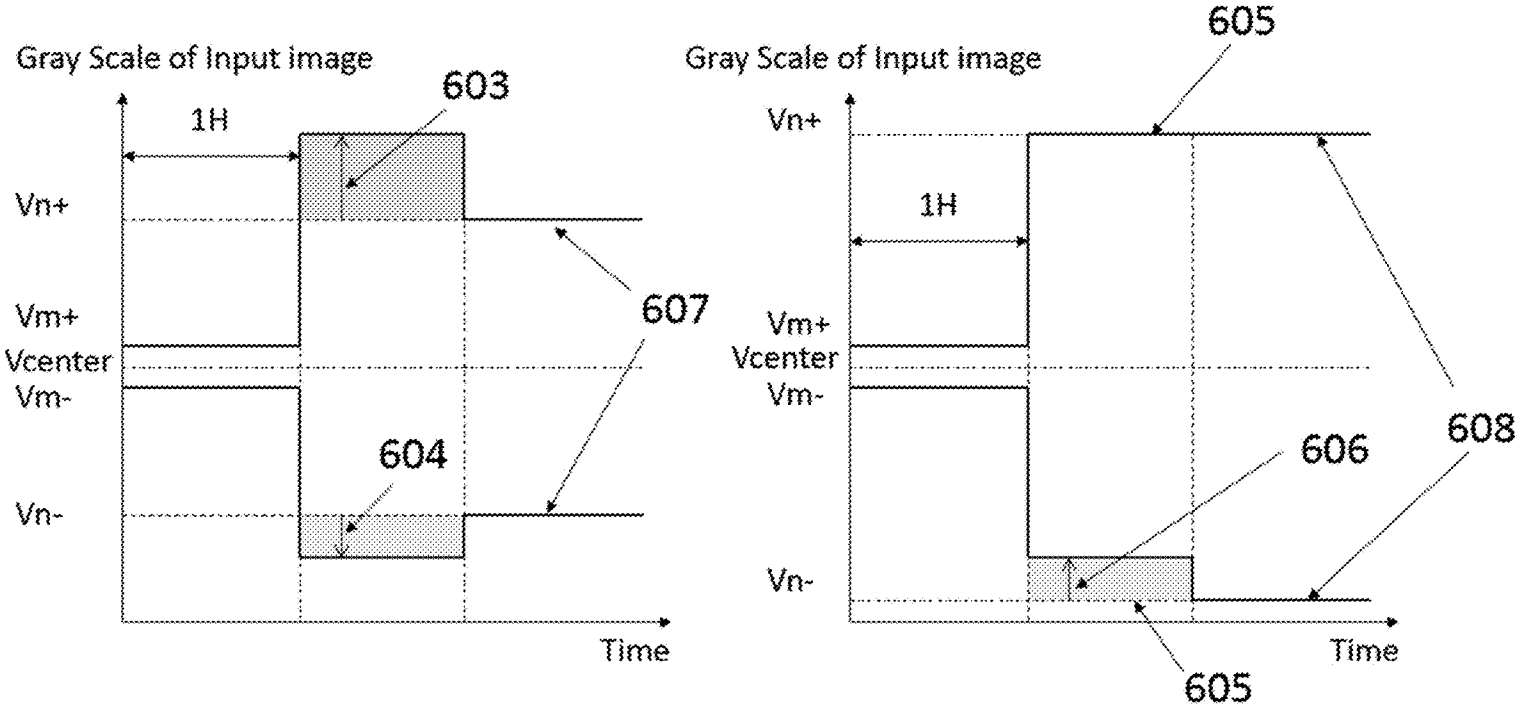
FIG. 6 is a schematic waveforms showing a comparison of the cases where: (1) the target gray scales are the intermediate level; and (2) the target gray scales are the brightest level according to an exemplary embodiment.

Turning now to FIG. 6, FIG. 6 compares the cases where (i) the target gray scales are an intermediate level; and (ii) the target gray scales are the brightest level, according to an exemplary embodiment. In particular, the left waveform 601 illustrates the state of the driving voltage (the gray scale of input image) when a target gray scale level (Vn) is an intermediate level, and the right waveform 602 illustrates the state of the driving voltage when the target gray scale level (Vn) is the brightest level (an absolute value of the driving voltage is the highest). Also, in FIG. 6, a positive driving voltage and a negative driving voltage are compared.

As shown on the left waveform 601, to charge a pixel up to the target gray scale level (Vn), the target voltage is supplemented to be the corrected charge voltage. Here, the negative supplemental voltage 604 is less than the positive supplemental voltage 603 because the negative driving voltage may charge the pixel faster than the positive voltage. In other words, the negative voltage is less than the positive voltage in achieving the same target gray scale (Vn), so the negative voltage can be better written in a pixel than a positive voltage. Thus, the absolute value of the corrected charge voltage value is relatively small if the polarity of the drive signal is a negative compared to a case that the polarity of the drive signal is a positive in achieving the same gray scale. Referring to FIG. 7D, as a specific example, a data driver applies a target gray scale of "zero" to a data line in n-horizontal period, and then applies the target gray scale of "768" in (n+1)-horizontal period, and then applies the target gray scale of "768" in (n+2)-horizontal period. According to the look up table in FIG. 7D, the absolute value of the supplemental voltage value (a gap of voltages which are applied to the data line by the data driver between in (n+1)-horizontal period and in (n+2)-horizontal period) is 0.182 [v] in a case of positive polarity, while the absolute value of the supplemental voltage value is 0.166 [v] in a case of negative polarity (if the writing voltage is a negative polarity, it may achieve the same target gray scale with the less amount of supplemental voltage).

Referring back to exemplary FIG. 6, as shown on the left waveform 601, if the target gray scale (Vn) is an intermediate level, the real data voltage 607 may be supplemented with the positive supplemental voltage 603 and the negative supplemental voltage 604 to be the corrected charge voltage. However, as shown in right waveform 602, if the target gray scale (Vn) is the brightest level (the highest absolute value of the writing voltage), the real data voltage 608 may not supplemented because there is no room 605 to supplement voltage for the corrected charge voltage. Referring to FIG. 7D, as a specific example, a data driver applies a target gray scale of "zero" to a data line in n-horizontal period, then applies the target gray scale of "1023" in (n+1)-horizontal period, and then applies the target gray scale of "1023" in (n+2)-horizontal period. According to the look up table in FIG. 7D, the supplemental voltage value (a gap of voltages which are applied to the data line by the data driver between in (n+1)-horizontal period and in (n+2)-horizontal period) is "0" [v] in a case of positive polarity, while the supplemental voltage value is "+0.250" [v] in a case of negative polarity.

Referring back to exemplary FIG. 6, as shown in the right waveform 602, in an exemplary embodiment, to avoid an after image, a reverse supplement voltage 606 may be applied for the negative driving input voltage to be the corrected charge voltage, which is smaller than the real data voltage 608. Thus, as the above example of FIG. 7D, in the case of negative polarity, the corrected charge voltage value is "+0.250" [v] ("+" in the negative table 702 means "reverse" and the detail explanation is to be discussed below).

Figure 1:
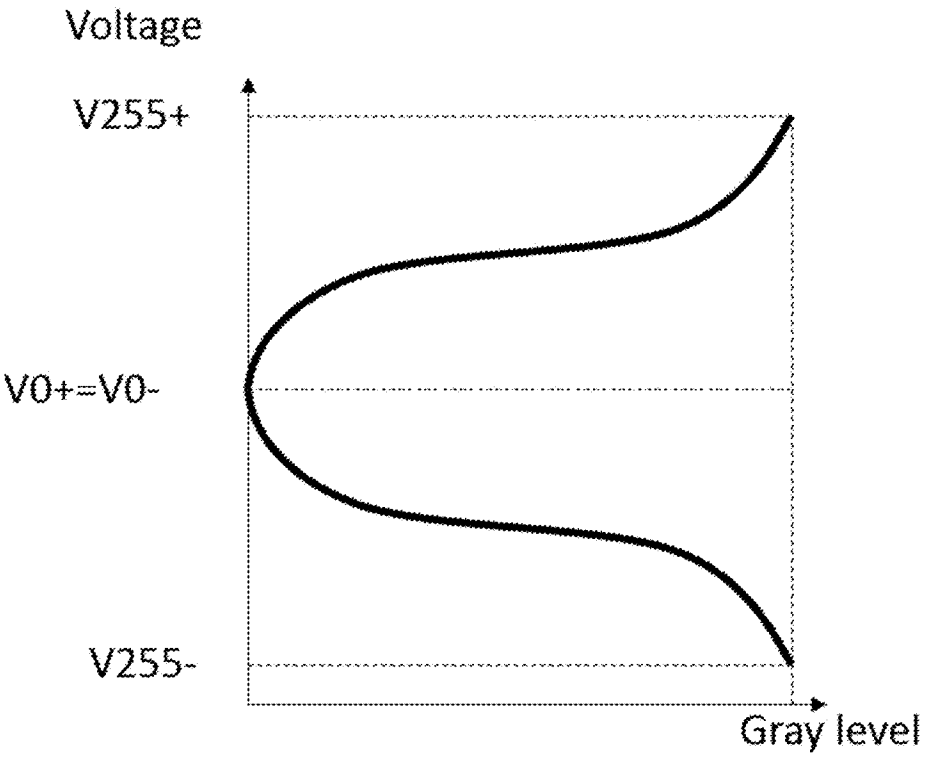
FIG. 1 is a graph illustrating the relationship between the voltage and the gray scale level.
Figure 2:
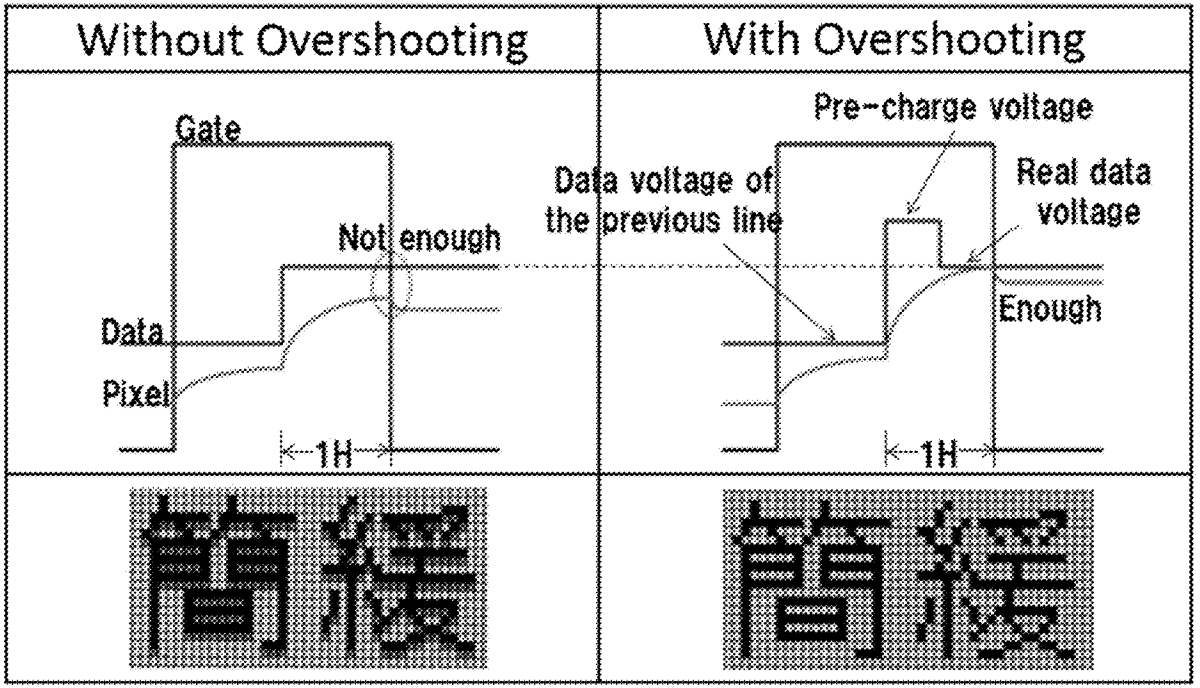
Prior Art Fig. 2
FIG. 2 is a schematic waveforms showing a comparison of the cases: (1) a short charged pixel without the initial high pre-charge voltage; and (2) a fully charged pixel with the initial high pre-charge voltage.
Figure 3:
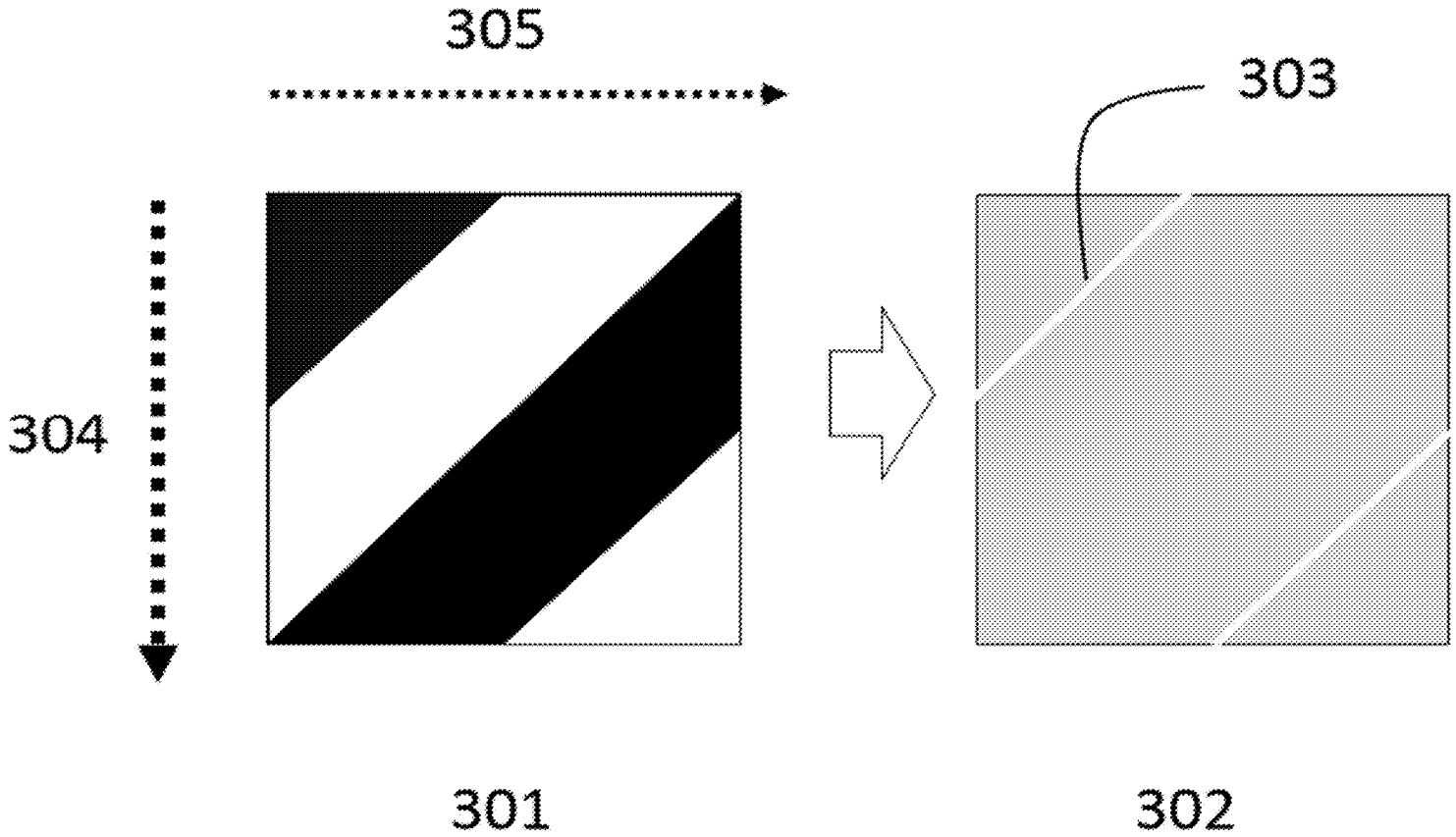
FIG. 3 is a view showing an exemplary display of the after image.

Referring back to exemplary FIG. 3, in order to help understanding about the cause of the after image, each pixel which connected vertically by the data line is charged in order along the data line direction 304 during each corresponding horizontal period which are in sync with the gate on signals from each gate line connected to each pixel. In a frame of an intermediate gray scale 302, the after image 303 occurs where a gray scale arrangement of one frame is changed from black (non-white) to white along with the data line direction 304 in the previous frame 301. The after image 303 which occurs on a boundary between black and white can be darker, as well as brighter. The figures illustrates the after image 303 as brighter, but it also can be darker depending what kind of LCD panel (normal black or white) is used or how the gray scale number order is decided.

Figure 7B:
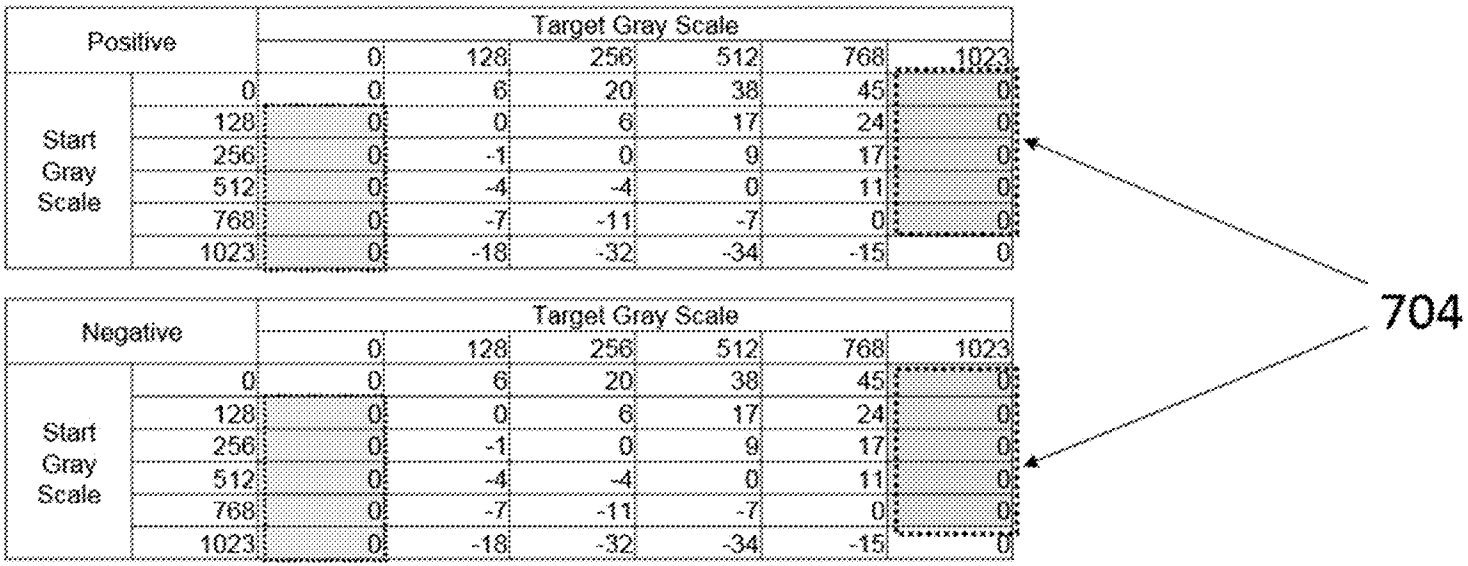
FIG. 7B provides exemplary look up tables showing the corrected charge voltage data as a gray scale value as a real case.
Figures 8A, 8B:
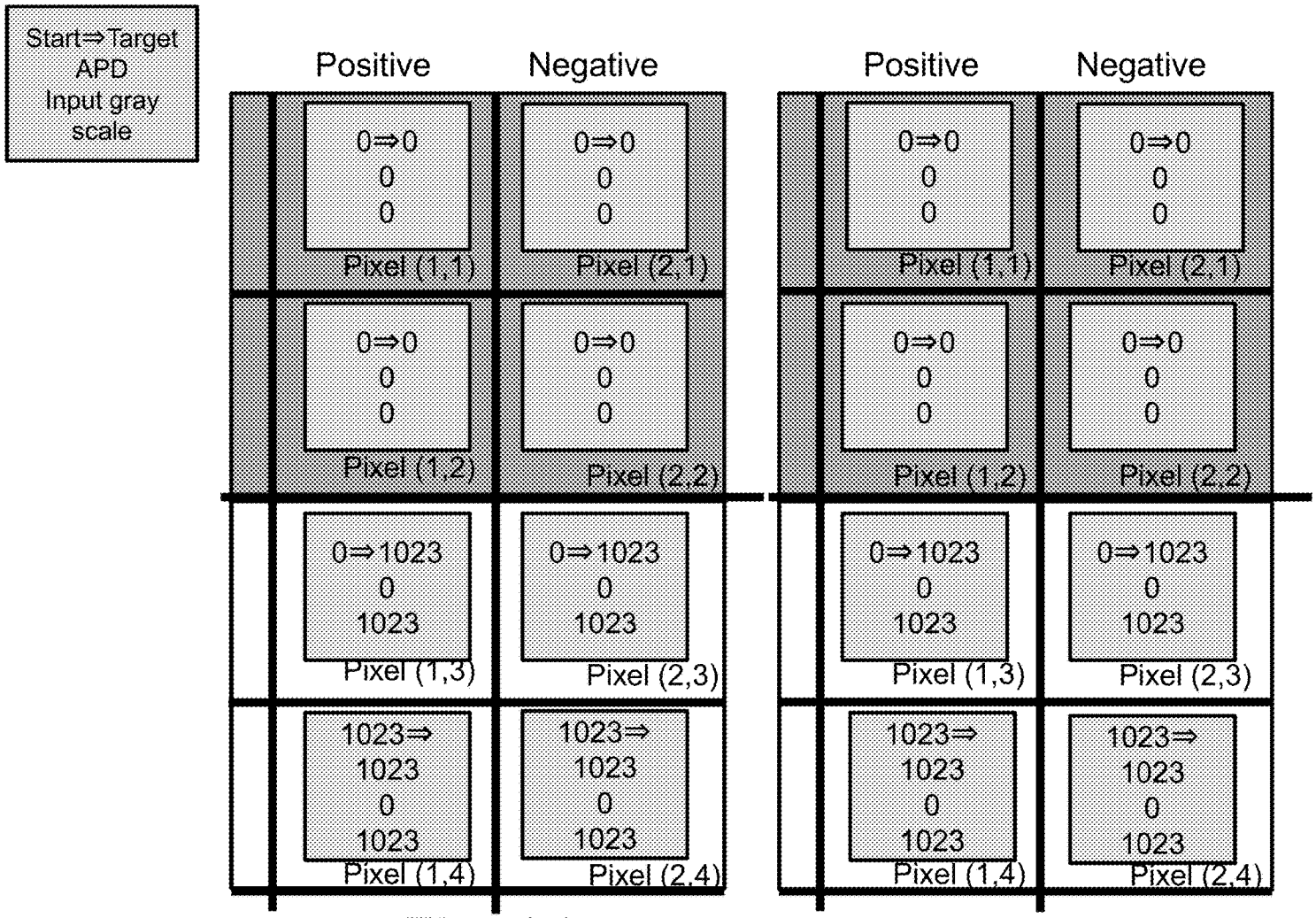
FIG. 8A is a schematic view illustrating the state of the after image.
FIG. 8B is a schematic view illustrating the state that the after image is solved according to an exemplary embodiment.

Referring now to exemplary FIG. 8A, the pixels may be arranged in matrix where the pixels may be connected via a data line 801 vertically (the data line direction 304) and connected via a gate line 802 horizontally (the gate line direction 305). It may be noted that in exemplary FIGS. 8A and 8B, the pixels may be shown in a matrix and coordinates (X, Y) may be used to identify individual or multiple pixels. In FIG. 8A, the positive driving voltage is applied to the pixels (1, 1-4) via the data line 801 and the negative driving voltage is applied to the pixels (2, 1-4). As described above, the pixels are charged by the driving voltage in the order of the data line directions: from (1, 1) to (1, 4) and from (2, 1) to (2, 4). The driving voltage signal is transited from its minimum to its maximum when the charging of pixels proceeds from the pixel (1, 2) to the pixel (1, 3) and the pixel (2, 2) to the pixel (2, 3). Also, as described above, the driving voltage applies writing voltage based on the look up table of FIG. 7B. According to the look up table in FIG. 7B, as shown value 704 (the start gray scale is "zero" and the target gray scale is "1023"), the pixels (1, 3) and (2, 3) is not supplemented because there is no room to supplement for the corrected charge voltage. As also described above, the negative driving voltage may charge the pixel faster than the positive voltage. Thus, the gray scale levels which are actually displayed on the pixel (1, 3) and the pixel (2, 3) are different. For example, the pixel (1, 3) actually displays "1000" and the pixel (2, 3) actually displays "1015". Also, it should be noted that the polarities of each data line may be changed in each frame. For example, the pixel (1, 3) may be negatively charged in the next frame, then the pixel (1, 3) may be charged as positive, then negative and positive charging may be continued. Accordingly, after many times of data writing have been performed, a negative bias-charge may be imposed on the pixel (1, 3) as well as the pixel (2, 3) because the polarities of the pixel (1, 3) and the pixel (2, 3) may continue to be changed.

Referring to exemplary FIG. 8B, to solve the after image, the driver applies the corrected charge voltage to the pixel (2, 3) with the reverse supplement gray scale. Then, the gray scale which the pixel (2, 3) actually displays is reduced ("1015"→"1000") to be the same as the pixel (1, 3). Accordingly, no bias-charge is imposed on the pixels (1, 3) and the pixel (2, 3), which does not cause an after-image.

Figure 7A:
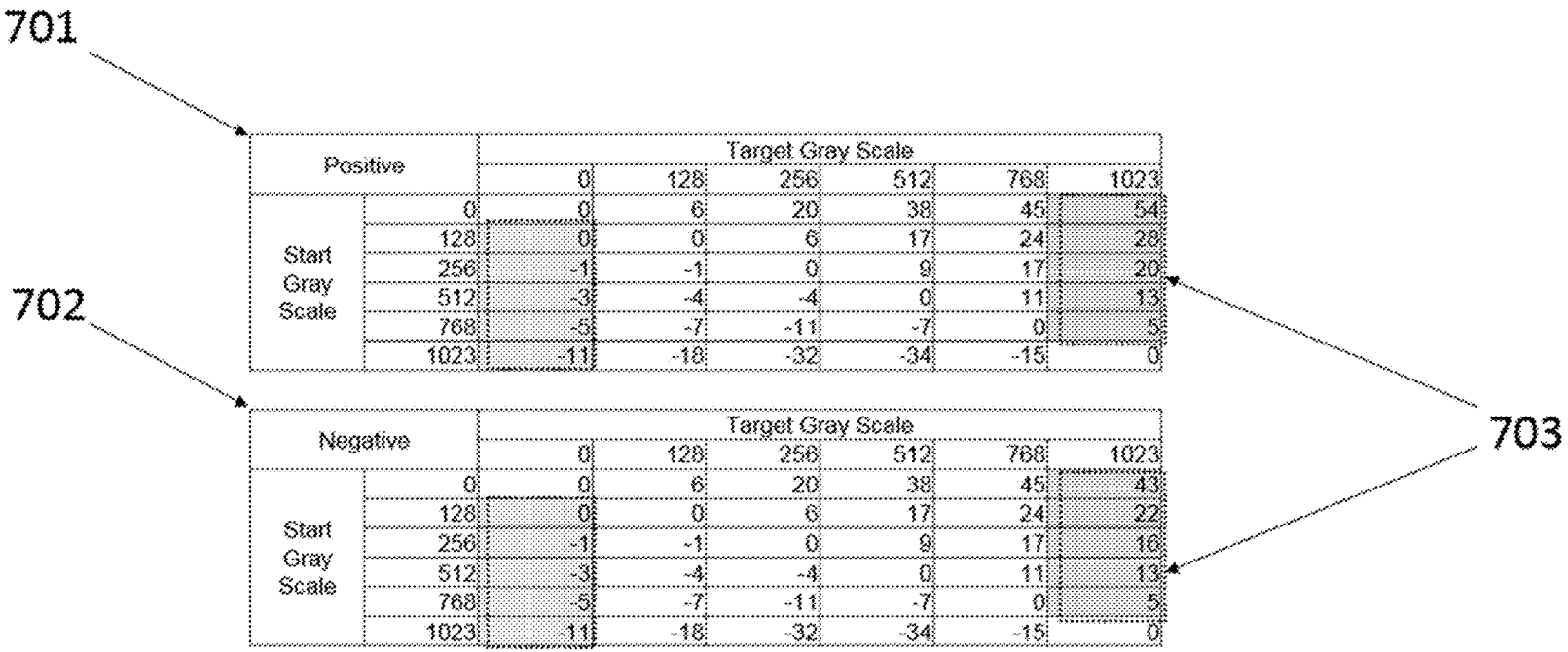
FIG. 7A provides exemplary look up tables showing the corrected charge voltage data as a gray scale value as an ideal case.

Turning now to exemplary FIGS. 7A, B, C and D, FIGS. 7A, B, C and D show look up tables which can contain the supplement data for the corrected charge voltage. In an exemplary embodiment, the driver inputs the corrected charge voltage as the drive signal to each pixel and the voltage of the drive signal may be decided by corrected charge voltage data which stored in a memory. Also, as described above, all data may be stored in the memory as a set of look up tables. The look up tables may be a gray scale version as FIGS. 7A, B and C, of which the supplement data for the corrected charge voltage is described as gray scale values. Also, like FIG. 7D, the look up tables may be a voltage version of which the corrected charge voltage data is described as the actual voltage values. Also, in another exemplary embodiment, the supplement data for the corrected charge voltage may be substituted as the corrected charge voltage value.

As shown in FIG. 7A, the look up tables may be a pair of a positive lookup table 701 and a negative lookup table 702. The positive lookup table 701 is for the driving voltage of positive polarity and the negative lookup table 702 is for the driving voltage of negative polarity. Both the positive and negative look up tables may have a plurality of positive or negative data. According to an exemplary embodiment, the controller controls the driver to input a corrected charge voltage as the drive signal to the LCD pixel through use of the positive lookup table 701 if the polarity of the driving signal has a positive charge and the negative lookup table 702 if the polarity of the driving signal has a negative charge.

Both the positive and negative look up tables may have starting gray scale levels and target gray scale levels with a range from minimum level to maximum level. In the lookup tables, each supplement data for the corrected charge voltage or each corrected charge voltage value is determined depending on, from which level of the start gray scale to which level of the target gray scale, the gray scale is transited. According to an exemplary embodiment, the starting gray scale level may be a gray scale level of an LCD pixel on a current horizontal period and the target gray scale is a gray scale level of an LCD pixel on a next horizontal period. Also, in another exemplary embodiment, the starting gray scale level may be a gray scale level of an LCD pixel on a previous horizontal period and the target gray scale is a gray scale level of an LCD pixel on a current horizontal period.

Exemplary FIG. 7A shows the lookup tables of an ideal case where there are valid supplement data 703 even though the target gray scale is a maximum or a minimum. However, in reality, as shown at the look up tables of FIG. 7B, if the gray scale is transited to a maximum or a minimum level, for example white or black, the corrected charge voltage data 704 is zero because there is no room to supplement voltage for next horizontal period. In particular, with reference to the right waveforms 602 of exemplary FIG. 6, the positive corrected charge voltage is already a maximum in the current horizontal period, and there is no room to supplement another corrected charge voltage for a pixel on the next horizontal period.

To avoid the after image problem, as shown at the negative look up table of FIG. 7C, the corrected charge voltage is to be reduced by the reverse supplement value 705 in the case that the gray scale is transited to maximum gray scale level. Here, the reverse supplement value 705 is predetermined to be sufficient to avoid an after image. Also, in an exemplary embodiment, if the target gray scale is at the maximum (brightest) level, the controller uses the negative lookup table to control the driver to input the reduced corrected charge voltage which is reduced by the reverse supplement value 705 as the drive signal.

FIG. 7D shows look up tables of the corrected charge voltage data which is described as actual voltage values. Unlike the gray scale version, in the voltage version, the positive value means a voltage with a positive polarity in the positive lookup table, but the positive value means a voltage with a negative polarity in the negative supplemental lookup table. Also, the negative value means a voltage with a negative polarity in the positive lookup table, but the negative value means a voltage with a positive polarity in the negative lookup table. Also, the voltage version describes in detail, as an example, how the negative corrected charge voltage value has an absolute value less than or equal to the positive corrected charge voltage value for a same gray scale level.

The foregoing description and accompanying figures illustrate the principles, preferred embodiments and modes of operation of the application. However, the invention should not be construed as being limited to the particular embodiments discussed above. Additional variations of the embodiments discussed above will be appreciated by those skilled in the art (for example, features associated with certain configurations of the application may instead be associated with any other configurations of the application, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A liquid crystal display (LCD) device comprising:

a plurality of LCD pixels in a matrix;

a driver that inputs a drive signal to each LCD pixel of the plurality of LCD pixels;

a controller that controls a level and a polarity of the drive signal; and a memory storing a plurality of corrected charge voltage values;

wherein each LCD pixel in the plurality of LCD pixels is provided with the drive signal based on the corrected charge voltage values for the corresponding LCD pixel during the entirety of a horizontal period, and wherein the corrected charge voltage value has a predetermined value corresponding to a charge for an intended gray scale level of the LCD pixel at the end of the horizontal period.

2. The display device of claim 1, wherein the corrected charge voltage value has the predetermined value that of the LCD pixel to be charged up to the intended gray scale level at the end of the horizontal period without an over shooting of the drive signal.

3. The display device of claim 1, wherein the driver inputs the drive signal to each LCD pixel in the plurality of LCD pixels selectively.

4. The display device of claim 1, wherein an absolute value of the corrected charge voltage value is less for a predetermined gray scale level when the polarity of the drive signal is a negative than the absolute value of the corrected charge when the polarity of the drive signal is a positive for the predetermined gray scale level.

5. The display device of claim 1, wherein the memory further comprises a plurality of look up tables having positive corrected charge voltage values and negative corrected charge voltage values of the corrected charge voltage values based on a polarity of a driving voltage, a pixel location, and a temperature of the display.

6. The display device of claim 5, wherein the controller controls the level of the drive signal depending on an absolute value of the corrected charge voltage values.

7. The display device of claim 5, wherein the memory further comprises:

at least one of a positive and negative lookup table pair having a plurality of positive and negative corrected charge voltage values, a plurality of starting gray scale levels from a minimum level to a maximum level, and a plurality of target gray scale levels from a level to a maximum level.

8. The display device of claim 7, wherein the starting gray scale level is a gray scale level of the LCD pixel on a previous horizontal period and the target gray scale is a gray scale level of the LCD pixel on a current horizontal period.

9. The display device of claim 7, wherein the controller controls the driver to input a corrected charge voltage value as the drive signal to the LCD pixel through use of the positive lookup table when the polarity of the driving signal has a positive charge and the negative lookup table when the polarity of the driving signal has a negative charge.

10. The display device of claim 7, wherein at least one of the positive and negative corrected charge voltage values in the lookup table are determined by each starting gray scale level and each target gray scale level.

11. The display device of claim 7, wherein, when the target gray scale level of the negative lookup table is at the brightest level, the corrected charge voltage value is a predetermined negative corrected charge voltage value that is sufficient to avoid an after image.

12. The display device of claim 1, wherein, when a target gray scale of a first pixel and a second pixel is at the brightest level, the controller controls the driver to input a first corrected charge voltage as the drive signal to the first pixel and to input a second corrected charge voltage as the drive signal to the second pixel, wherein the polarity of the drive signal, is a positive for the first pixel and the polarity of the drive signal is a negative for the second pixel, and wherein the first pixel displays a predetermined luminescence with the first corrected charge voltage and the second pixel displays the predetermined luminescence with the second corrected charge voltage.

* * * * *